US005092048A

United States Patent [19]

Sukow et al.

[11] Patent Number: 5,092,048

[45] Date of Patent: Mar. 3, 1992

[54] CUTTING HEAD ASSEMBLY FOR HAIR TRIMMERS

[75] Inventors: Daniel L. Sukow, Grafton; Daniel C. Quella; Matthew L. Andis, both of Racine, all of Wis.

[73] Assignee: Andis Company, Racine, Wis.

[21] Appl. No.: 595,545

[22] Filed: Oct. 11, 1990

[51] Int. Cl.[5] ..... B26B 19/02; B26B 19/08; B26B 19/12

[52] U.S. Cl. ..... 30/210; 30/208; 30/221

[58] Field of Search ..... 30/208, 209, 210, 211, 30/220, 221, 222

[56] References Cited

U.S. PATENT DOCUMENTS

| | | | |
|---|---|---|---|
| 1,956,042 | 4/1934 | Oster | 30/221 |
| 2,182,597 | 12/1939 | Oster | 30/196 |
| 2,542,378 | 2/1951 | Armbruser et al. | 30/208 |
| 2,928,171 | 3/1960 | Oster | 30/221 |
| 3,279,062 | 10/1966 | Andis | 30/210 |
| 4,081,905 | 4/1978 | Urbush | 30/221 |
| 4,694,575 | 9/1987 | Boerger | 30/221 |
| 4,765,060 | 8/1988 | Veselaski et al. | 30/208 |

*Primary Examiner*—Douglas D. Watts
*Assistant Examiner*—Paul M. Heyrana
*Attorney, Agent, or Firm*—Michael, Best & Friedrich

[57] ABSTRACT

A cutting head selectively engageable with a first support tongue having by a pair of ribs disposed on the bottom of the tongue, and selectively engageable with a second support tongue having a substantially planar bottom surface, the cutting head comprising a bottom plate having an upper surface, an upper plate supported by the upper surface, a spring fixed to the bottom plate for biasing the upper plate against the upper surface, and a single tongue-receiving socket for snugly receiving the first support tongue and for snugly receiving the second support tongue.

13 Claims, 3 Drawing Sheets

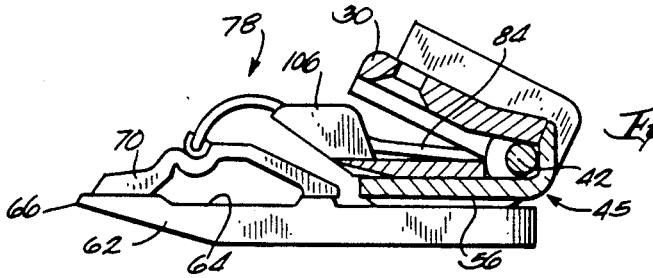
Fig. 8
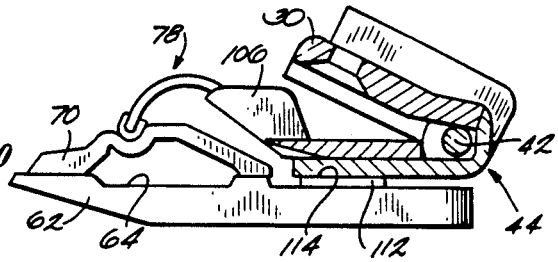
Fig. 10
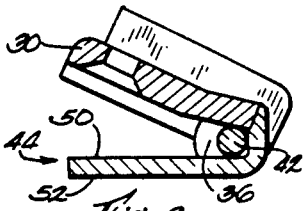
Fig. 9
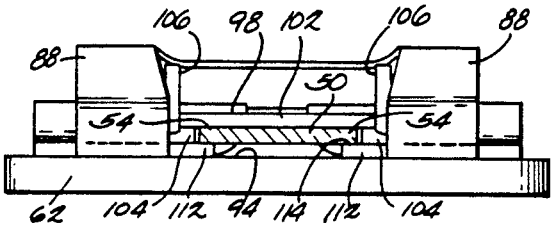
Fig. 11
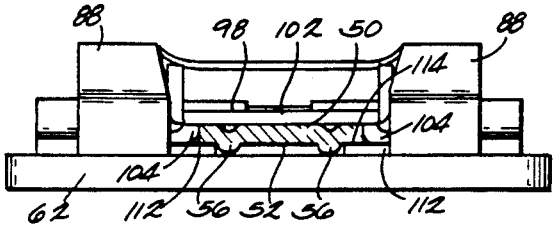
Fig. 12
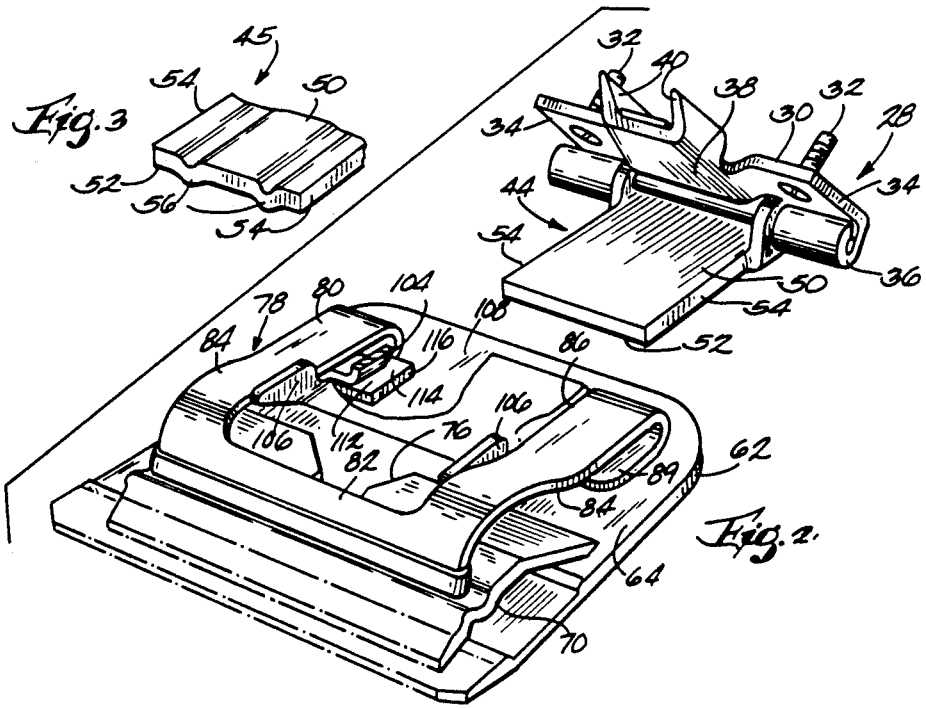
Fig. 3
Fig. 2.

CUTTING HEAD ASSEMBLY FOR HAIR TRIMMERS

BACKGROUND OF THE INVENTION

1. Technical Field

The invention relates to electric hair trimmers, and more particularly to cutting head assemblies for use with electric hair trimmers.

2. Related Prior Art

It is generally known to provide an electric hair trimmer with a cutting head assembly which can be releasably and operably mounted on the trimmer. The provision of a releasable cutting head assembly facilitates the cleaning and replacement of the cutting head assembly. Typically, an electric hair trimmer for use with a releaseable cutting head assembly includes a body and a spring-loaded, pivotable support tongue which is fixed to one end of the clipper body. The support tongue is engageable with the associated cutting head assembly to hold the cutting head assembly in an operable position on the clipper body. When the tongue is pivoted forwardly to an "open" position away from the body, the cutting head assembly can be placed on the tongue. When the tongue is snapped into a "closed" position against the clipper body, the cutting head assembly is held securely against the clipper body.

Two examples of releaseable cutting head assemblies for use in association with a hair trimmer are illustrated respectively in U.S. Pat. No. 2,182,597 which issued to Oster on Dec. 5, 1939, and in U.S. Pat. No. 2,928,171 which issued to Oster on Mar. 15, 1960. The above-listed U.S. Patents illustrate cutting head assemblies which include a tongue-receiving socket for mounting the assembly on an associated support tongue.

Under some circumstances, it may be desirable for cutting head assemblies to be interchangable between various electric clippers. Some cutting head assemblies cannot be interchangably mounted on some trimmers, however, because some trimmers provide a support tongue which has a specific configuration and which can only releasably engage a particular cutting head assembly having a correspondingly configured tongue-receiving socket, but which cannot releasably engage a cutting head assembly having a differently configured tongue-receiving socket.

For example, one type of support tongue known in the prior art has a relatively uniform thickness across the width of the tongue and has a generally planar bottom surface. Another type of support tongue known in the prior art has a varying thickness across the width of the tongue and is characterized by two ribs which are disposed on the bottom surface of the tongue and which extend downwardly. A cutting head assembly configured for use in association with a trimmer having the first type of support tongue, i.e. a tongue having a generally planar lower surface, cannot be used interchangeably with a trimmer having a support tongue including a ribbed bottom surface because the downwardly extending ribs prevent engagement of the tongue with the tongue-receiving socket.

SUMMARY OF THE INVENTION

One of the features of the invention is the provision of a cutting head assembly which can be releasably engaged with various support tongues having differing configurations.

Another feature of the invention is the provision of a cutting head assembly which can be releasably engaged with a support tongue having a generally planar lower surface as well as with a support tongue having ribs disposed on the bottom surface of the support tongue.

The invention also provides a cutting head assembly including means defining a single tongue-receiving socket for receiving a support tongue on an electric hair trimmer. The socket is adapted to receivably engage various support tongues having different configurations, and is adapted to releasably and operably mounting the cutting head assembly on the body of an electric hair trimmer.

In one embodiment, the tongue-receiving socket has a relatively uniform height across the width of the socket, and includes means extending inwardly of the socket to diminish the height of the socket at the ends of the socket. In one embodiment of the cutting head assembly, the tongue-receiving socket is defined by a bottom plate and a U-shaped strap which is fixed to the bottom plate and which has a central portion which is spaced away from the bottom plate. The means extending inwardly of the socket to diminish the height of the socket at the ends of the socket includes a pair of tabs which are fixed to the bottom plate and which extend under the ends of the central portion of the strap.

It is contemplated that the socket will snugly receive the type of support tongue having a planar bottom, as well as the type of support tongue having a ribbed bottom. When mounted on an electric hair trimmer having a support tongue with a planar lower surface, the socket engages the support tongue in a relatively snug manner so that the upper surfaces of the tabs engage the bottom surface of the tongue and the remainder of the socket envelopes the tongue so that when the support tongue is pivoted to a "closed" position against the clipper body, the cutting head assembly is securely and operably mounted on the electric clipper.

When mounted on an electric hair trimmer having ribs disposed on the bottom surface of the support tongue, the socket snugly receives the support tongue so that the upper surfaces of the tabs engage the bottom surface of the tongue and the inner ends of the tabs engage the sides of the ribs.

Various other features and advantages of the invention will become apparent to those skilled in the art upon review of the following detailed description, claims and drawings.

BRIEF DESCRIPTION OF THE DRAWINGS

FIG. 2 is a perspective view, partially broken away for illustration, of one embodiment of a Prior art support tongue and a cutting head assembly embodying various features of the invention.

FIG. 3 is a portion of an alternative embodiment of a prior art support tongue.

FIG. 8 is a view similar to FIG. 7 of the cutting head assembly engaged with the embodiment of a support tongue illustrated in FIG. 3.

FIG. 9 is a cross-sectional view of the support tongue illustrated in FIG. 2.

FIG. 10 is a view similar to FIG. 8 of the cutting head assembly shown in FIG. 7 engaged with the embodiment of a support tongue illustrated in FIG. 2.

FIG. 11 is an elevational rear view of the cutting head assembly shown in FIG. 10 with a portion of the support tongue broken away.

FIG. 12 is an elevational rear view of the cutting head assembly shown in FIG. 8 with a portion of the support tongue broken away.

Figure 1:
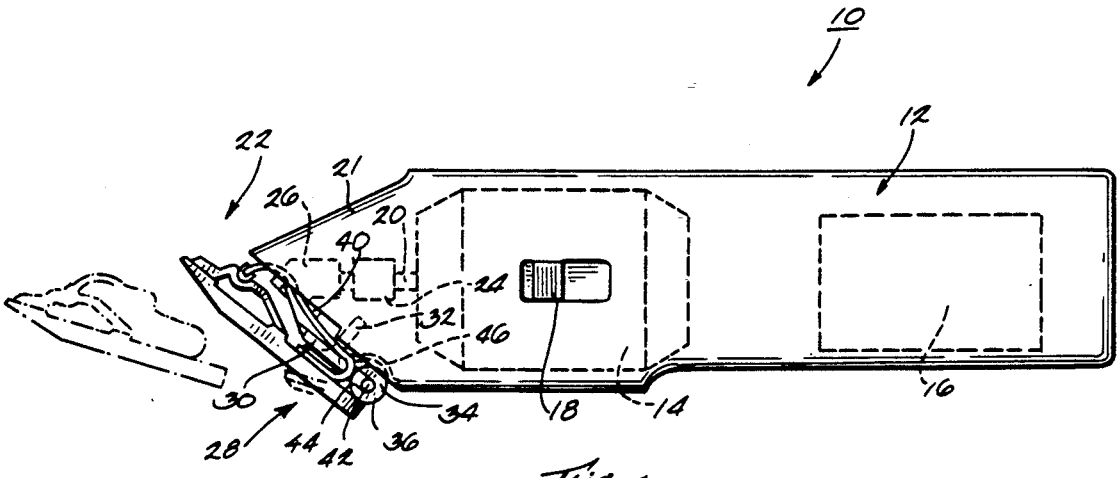
FIG. 1 is an elevational side view of an electric hair trimmer embodying various features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE OF THE PREFERRED EMBODIMENT

Illustrated in FIG. 1 is an electric hair trimmer 10 having a body 12 which is formed to be easily handheld. The body 12 houses an electric motor 14 which is connected to a suitable source of current 16 which, as shown schematically in FIG. 1, can be in the form of a battery. However, the trimmer body could also support an electric cord for connection with a suitable source of current. A user operable switch 18 for turning the electric motor 14 "on" and "off" extends from the clipper body 12. A rotatable drive shaft 20 extends from the electric motor 14 to an end 21 of the clipper body 12 which supports a cutting head assembly 22. The drive shaft 20 supports an eccentrically mounted cam 24 which, when rotated, imparts a reciprocating motion to a drive lever 26 which extends from the clipper body 12 and which, in turn, operably engages the cutting head assembly 22.

The hair trimmer 10 also includes mounting means 28 supported on the end 21 of the clipper body 12 for releasably engaging the cutting head assembly 22. While various features of the mounting means 28 are described herein, U.S. Pat. No. 2,182,597, which issued to Oster on Dec. 5, 1939, also describes means for readily removably attaching a cutting head assembly to a clipper body and for holding the cutting head assembly in place thereon. In the disclosed embodiment, the mounting means 28 includes (FIG. 2) a base plate 30 which is fixed to the end 21 of the clipper body 12 by a pair of: screws 32. The base plate 30 carries a pair of laterally spaced arms 34 which are curled to form a pair of hinge loops 36. A central portion 38 of the base plate 30 extends outwardly from the end 21 of the clipper body 12. A pair of side flanges 40 extend upwardly from the central portion 38 to either side of the drive lever 26.

As shown in FIG. 1, a hinge pin 42, which extends through the hinge loops 36, hingedly mounts a support tongue 44 in a position overlying the base plate 30. In the illustrated embodiment, the support tongue 44 is mounted on the clipper body 12 for pivotal movement from an "open" position (shown in phantom) wherein the tongue 44 extends forwardly away from the clipper body 12 to a second "closed" position wherein the tongue is held next to the clipper body 12. The mounting means 28 also provides a spring 46 which engages one end of the tongue 44 and the base plate 30 for holding the tongue 44 in either the "open" or "closed" position.

Figure 7:
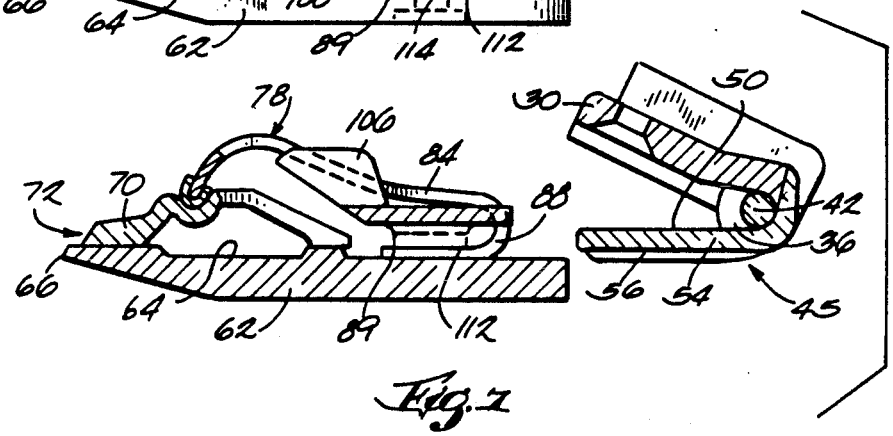
FIG. 7 is a cross-sectional view, taken along line 7—7, of the cutting head assembly shown in FIG. 4 and a cross-sectional view of the embodiment of a support tongue illustrated in FIG. 3.

The support tongue 44 may take the form of various configurations. One type of support tongue 44 shown in FIGS. 2 and 9 has an upper surface 50, a generally planar lower surface 52, opposite edges 54, and has a relatively uniform thickness. The support tongue 45 shown in FIGS. 3 and 7, has an alternative configuration including an upper surface 50, a lower surface 52, opposite edges 54, and a pair of ribs 56 disposed on the lower surface 52 and extending generally parallel to and being spaced from the opposite edges 54. Because the ribs 56 extend downwardly from the lower surface 52 of the ribbed support tongue 45, the support tongue 44 has an overall thickness which is greater than the thickness of the support tongue having a plannar bottom surface. While the alternative configurations of the support tongues 44, 45 have various different overall thicknesses, the alternative configurations typically have a standard width, i.e. the distance between the opposite edges 54 is the same for the alternative configurations of support tongue 44 and 45.

The above-mentioned cutting head assembly 22 includes (FIGS. 2 and 4) a bottom plate 62 having an upper surface 64 and a lead edge 66 characterized by a set of teeth 68. The upper surface 64 of the bottom plate 62 supports a top plate 70 for reciprocal sliding movement relative thereto. The top plate 70 has an edge 72 characterized by a second set of teeth (not shown) which cooperate with the set of teeth 68 on the bottom plate 62 to cut hair when the top plate 70 is reciprocated relative to the bottom plate 62. The top plate 70 defines a rearwardly opening channel 76 which is adapted to engage the drive lever 26 and is reciprocally driven by the drive lever 26.

The cutting head assembly 22 also includes (FIG. 2) spring means 78 for biasing the top plate 70 against the bottom Plate 62. In the preferred embodiment, the spring means 78 is a leaf spring 80 which includes a bight portion 82 positioned on the top plate 70 and two legs 84 extending rearwardly from the bight portion 82 to form therebetween a U-shaped space 86. While other arrangements can be used, in the disclosed embodiment, each leg 84 includes a curled portion 88 which extends under the leg 84 and terminates in an end 89 which is fixed to the upper surface 64 of the bottom plate 62. The leaf spring 80 biases the top plate 70 against the upper surface 64 of the bottom plate 62 to maintain sufficient pressure therebetween for effective cutting.

Figure 4:
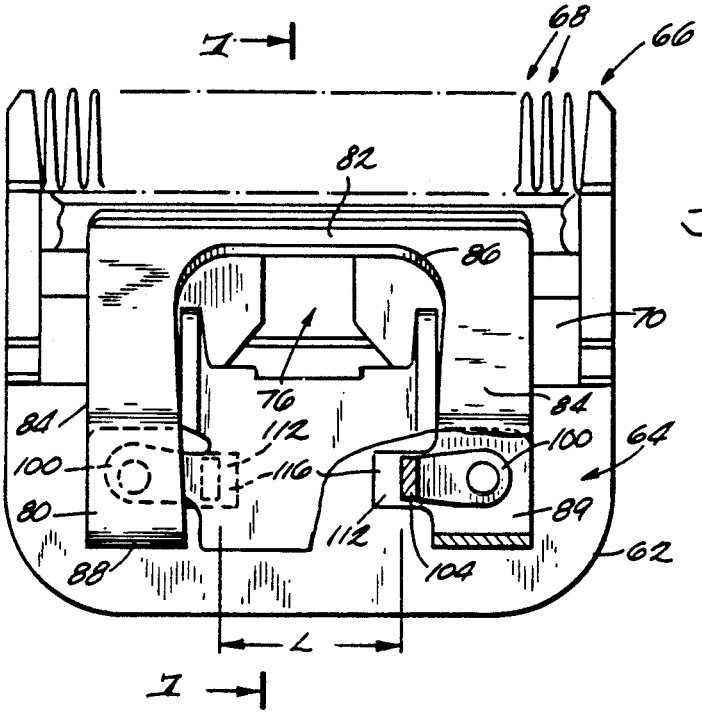
FIG. 4 is a plan view from above, partially broken away, of a cutting head assembly embodying various features of the invention.

In order to provide a cutting head assembly which is interchangable between electric hair trimmers having differing support tongue configurations, the cutting head assembly 22 (FIG. 5) provides means 90 defining a single tongue-receiving socket 91 for selectively and receivably engaging a support -tongue 44 having a generally planar bottom surface 52 (FIGS. 10 and 11), and for selectively and receivably engaging a support tongue 45 having ribs 56 disposed on the bottom surface 52 of the support tongue (FIGS. 8 and 12). While various other constructions could be used, in the illustrated embodiment, the socket defining means 90 includes (FIG. 5) the above-mentioned socket 91 which is defined by a pair of spaced-apart end walls 92, a bottom wall 94 and a top wall 96. A generally U-shaped strap 98 extends between the legs 84 of the spring 80 and defines the top wall 96 of the tongue-receiving socket 91. The strap 98 has opposite ends 100 and a central portion 102 which extends between the opposite ends 100 and which is spaced from the upper surface 64 of the bottom plate 62. As shown in FIG. 4, the opposite ends 100 of the strap 98 are fixed to an end 89 of a respective leg 84 of the leaf spring 80 so that the curled portions 88 of the spring 80 extend over the ends 100 of the strap 98. While not shown in the drawings, the strap 98 could also, for example, be fixed directly to the upper surface 64 of the bottom plate 62. Each end 100 of the strap 98 includes (FIGS. 2 and 5) a bent portion 104 which curves upwardly from the leg 84 of the spring 80 to the central portion 102 of the strap 98. The bent portions 104 provide a clearance between the upper surface 64 of the bottom plate 62 and the strap 98 which is greater than the thickness of the legs 84 of the spring 80. The ends 89 of the legs 84 and the bent portions 104 thus define the spaced-apart end walls 92 of the socket 91.

Figure 5:
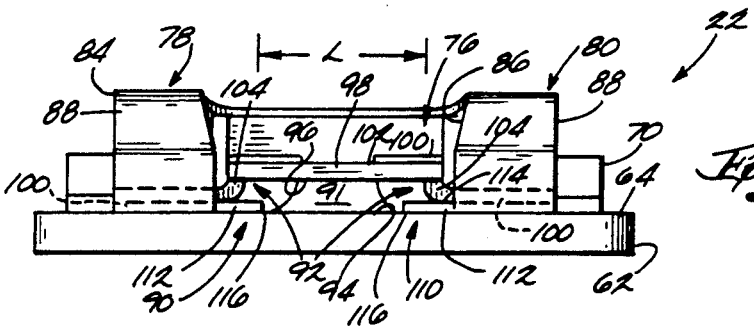
FIG. 5 is an elevational rear view of the cutting head assembly shown in FIG. 4.
Figure 6:
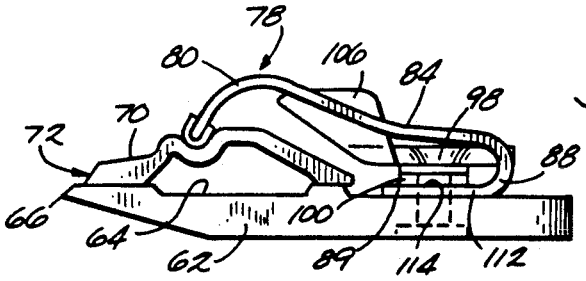
FIG. 6 is a elevational side view of the cutting head assembly shown in FIG. 5.

Because the various configurations of the support tongue 44 have a standard width, the end walls 92 are preferably spaced-apart, as indicated by dimension L in FIGS. 4 and 5, to correspond to the standard width of the support tongues.

As shown in FIG. 11, a pair of alignment flanges 106 extend upwardly from the central portion 102 of the strap 98. The alignment flanges 106 nest with the side flanges 40 on either side of the drive lever 26 to securely position the cutting head assembly 22 when the support tongue 44 is snapped into the closed position.

The socket defining means also includes (FIG. 1) a portion 108 of the upper surface 64 of the bottom plate 62 which extends between the legs 84 of the spring 80 and which defines the bottom wall 94 of the tongue-receiving socket 91. As shown in FIG. 5, the central portion 102 of the strap 98 and the portion 108 of the bottom plate 62 are relatively uniformly spaced-apart so that the socket has a substantially uniform height.

The cutting head assembly 22 also includes (FIG. 5) means 110 extending inwardly of the socket 91 from the end walls 92 for diminishing the height of the socket 91 at each end of the socket 91. While various arrangements could be used, in the illustrated embodiment, the means 110 extending inwardly of the socket 91 to diminish the height of the socket 91 includes a pair of tabs 112. Each tab 112 is integrally formed on a leg 84 of the spring 80 and extends inwardly of the socket 91. Thus, the ends 100 of the strap 98 are respectively fixed to the pair of tabs 112. In the preferred embodiment, each tab 112 has a thickness substantially equal to the thickness of the legs 84. Because of the upwardly extending bent portions 104 of the strap 98, the central portion 102 of the strap 98 is spaced from the upper surface 114 of each tab 112. The bent portions 104 of the strap 98 provide sufficient clearance between the upper surface 114 of the tabs 112 and the central portion 102 so that the edges 54 of a support 44 tongue can be snugly and slideably received therebetween. The innermost ends 116 of the tabs 112 terminate in rib engaging surfaces which are spaced-apart so that the ribs 56 on the lower surface 52 of a support tongue 44 can be snugly and slideably received therebetween.

As shown in FIGS. 10 and 11, the socket 91 is adapted to receive the relatively thin support tongue 44 such that the plannar lower surface 52 of the tongue 44 is received on the upper surface 114 of the tabs 112 and is held snugly by the strap portion 98 and the bent portions 104 of the strap 98. The socket 91 is also adapted to receive a support tongue having ribs 56 disposed on the lower surface 52 of the tongue 44. As shown in FIGS. 8 and 12, the ribbed tongue 45 can be snugly received by the socket 91 such that the inner ends 116 of the tabs 112 engage the sides of the ribs 56, the lower surface 52 of the tongue 44 extends over the upper surface 114 of the tabs 112, and the upper surface 50 of the tongue 44 is snugly received by the strap portion 98. The socket 91 defining means thus provides a cutting head assembly 22 which snugly receives alternative embodiments of known support tongues and is interchangeable between hair trimmers having support tongues of various configurations.

Various features of the invention are set forth in the following claims.

We claim:

1. A cutting head selectively useable with a first electric hair trimmer having a first support tongue with a first width and a first height and with a second electric hair trimmer having a second support tongue with a second height greater than said first height and a second width less than said first width, said cutting head comprising a bottom plate, an upper plate supported by said bottom plate, spring means fixed to said bottom plate for biasing said upper plate against said bottom plate, and socket means for selectively receiving either one of the first and second support tongues, said socket means being defined by a pair of spaced-apart tabs fixed on said bottom plate, said pair of tabs having respective upper surfaces and respective inner surfaces spaced at the second width, a portion of said bottom plate extending between said tabs and a strap member having a first end fixed to one of said tabs, a second end fixed to the other of said tabs and spaced from said first end at the first width, and a central portion extending between said first end and said second end and biasing spaced from said upper surface of each of said pair of tabs at the first height and being spaced from said portion of said bottom plate the second height.

2. A cutting head as set forth in claim 1 wherein said spring means includes a leaf spring having two legs and a bight portion extending between said two legs, each leg being fixed to said bottom plate adjacent a respective one of said tabs.

3. A cutting head as set forth in claim 2 wherein one of said two legs is integrally formed with said one tab, and wherein the other of said two legs is integrally formed with said other tab.

4. A cutting head as set forth in claim 3 wherein each of said legs includes a curled portion extending between each respective end and said bight portion, each of said curled portions extending upwardly from said respective end and over an end of said strap.

5. A cutting head selectively engageable with a first support tongue having by a pair of ribs disposed on the bottom of the tongue, and selectively engageable with a second support tongue having a substantially planar bottom surface, the cutting head comprising a bottom plate having an upper surface, an upper plate supported by said upper surface, spring means fixed to said bottom plate for biasing said upper plate against said upper surface, and means defining a single tongue-receiving socket for snugly receiving the first support tongue and for snugly receiving the second support tongue.

6. A cutting head as set forth in claim 5 wherein said spring having a pair of legs means includes a leaf spring and a bight portion extending between said legs to form therebetween a U-shaped space, each of said legs having an end fixed to said upper surface of said bottom plate and a tab formed on each of said ends and extending inwardly of said U-shaped space.

7. A cutting head as set forth in claim 6 wherein said means defining a tongue-receiving socket includes a strap extending across said U-shaped space, said strap including a central portion spaced away from said tabs and said upper surface of said bottom plate, said strap, said tabs, and said upper surface of said bottom plate forming a tongue receiving socket adapted to engage the relatively thick tongue and the relatively thin tongue.

8. A cutting head as set forth in claim 6 wherein each of said legs includes a curled portion extending between said bight portion and said end, said curled portion extending upwardly from said end and over said strap.

9. A cutting head assembly selectively usable with a first electric hair trimmer having a support tongue with a substantially planar bottom surface and with a second electric hair trimmer having a support tongue with a pair of ribs disposed on the bottom thereof, said cutting head assembly comprising a bottom plate, and socket means on said bottom plate for selectively receiving either one of the support tongues, said tongue receiving means including a pair of spaced apart end walls, a bottom wall extending between said end walls and a top wall extending between said end walls and being spaced from said bottom wall, said top wall, said end walls and said bottom wall defining a single socket having a substantially uniform height extending centrally between said end walls and said tongue receiving means also including means extending inwardly of said socket from each of said end walls for diminishing said height of a portion of said socket.

10. A cutting head assembly as set forth in claim 9 and further including an upper plate supported by said bottom plate, and spring means for biasing said upper plate against said bottom plate, and wherein said spring means defining said end walls.

11. A cutting head assembly as set forth in claim 9 wherein said cutting head assembly further includes a strap fixed to said bottom plate, and wherein a portion of said strap defines said top wall of said socket.

12. A cutting head assembly as set forth in claim 11 wherein said strap is fixed to said spring means.

13. A cutting head assembly as set forth in claim 9 wherein said bottom plate includes an upper surface, and wherein said bottom wall includes a portion of said upper surface of said bottom plate.

* * * * *